US006859772B2

(12) United States Patent
Tsoi et al.

(10) Patent No.: US 6,859,772 B2
(45) Date of Patent: Feb. 22, 2005

(54) MIXED SIGNAL DYNAMICAL ENVIRONMENT MODELING

(75) Inventors: Ah Chung Tsoi, Kenmore (AU); Liang Suo Ma, Wollongong (AU)

(73) Assignee: Motorola, Inc., Schaumburg, IL (US)

( * ) Notice: Subject to any disclaimer, the term of this patent is extended or adjusted under 35 U.S.C. 154(b) by 485 days.

(21) Appl. No.: 10/140,604

(22) Filed: May 7, 2002

(65) Prior Publication Data

US 2003/0212553 A1 Nov. 13, 2003

(51) Int. Cl.[7] ..... G10L 11/00
(52) U.S. Cl. ..... 704/200; 370/268
(58) Field of Search ..... 704/200; 370/263, 370/268

(56) References Cited

U.S. PATENT DOCUMENTS 5,959,966 A * 9/1999 Torkkola ..... 370/203
6,236,862 B1 * 5/2001 Erten et al. ..... 455/501
6,625,587 B1 * 9/2003 Erten et al. ..... 706/22

OTHER PUBLICATIONS

L. Zhang and A. Cichocki, Blind Deconvolution of Dynamical Systems: A State Space Approach, *Journal of Signal Processing*, vol. 4, No. 2, Mar. 2000, pp. 111–130; and.

Ober, "Balanced Parametrisation of Classes of Linear Systems" *SIAM Journal Control and Optimisation*, vol. 29, pp 1251–1287, 1991.

Ct. Chou and J.M. Maciejowski, "System Identification Using Balanced Parametrization", *IEEE Trans. Automatic Control*, vol. 42, pp. 956–974, 1997.

* cited by examiner

*Primary Examiner*—Daniel Abebe

(57) ABSTRACT

A device (2) and method (20) for providing a balanced parameterized description of a dynamical environment having a plurality of signal sources. The method (20) includes inverse transforming (25) an initial reduced cost set of discrete time parameters into a reduced cost set of continuous time parameters and then converting (26) the reduced cost set of continuous time parameters into a balanced converted set of parameters. A transforming step (26) for transforming the balanced converted set of parameters into a modified set of discrete time parameters is then effected and thereafter an estimating step (28) estimates from the modified set of discrete time parameters a balanced reduced cost set of discrete time parameters. Steps (25) to (28) are repeated until the balanced reduced cost set of discrete time parameters provides a rate of change value of a cost function that reaches a pre-determined value. A providing step (30) provides for the balanced parameterized description of the dynamical environment from the balanced reduced cost set of discrete time parameters. Order reducing (31) and inverting steps (32) provide for an inverted reduced cost set of discrete time parameters.

8 Claims, 2 Drawing Sheets

MIXED SIGNAL DYNAMICAL ENVIRONMENT MODELING

FIELD OF THE INVENTION

This invention relates to mixed signal modeling. The invention is particularly useful for, but not necessarily limited to, separating and recovering speech signals simultaneously recorded in a mixed form or used for separating the speech of a particular speaker in the situation with multiple speakers and other sources of noise are present.

BACKGROUND ART

Separation of multiple signals from their superposition recorded at several sensors is an important problem that shows up in a variety of applications such as communications, biomedical and speech processing. The separation task is made difficult by the fact that very little is known about the transmission channel or the input signals and thus the separation is commonly referred to as blind.

In L. Zhang and A. Cichocki, "Blind Deconvolution of Dynamical Systems: A State Space Approach', *Journal of Signal Processing*, vol. 4, No. 2, Mar. 2000, pp. 111–130 a controller canonical parametrization of the mixing system is described.

In Ober, "Balanced Parametrisation of Classes of Linear Systems" *SIAM Journal Control and Optimisation*, Vol 29, pp 1251–1287, 1991" there is described a method of Balanced Parametrisation exclusively within the continuous-time domain.

The above prior art does not provide for a balanced parametrization that avoids problems of pre-estimation of the order of the mixing system, instability of the mixing system due to pole-zero cancellation and estimation of a balanced parametrization of the mixing system in the discrete-time domain.

In this specification, including the claims, the terms 'comprises', 'comprising' or similar terms are intended to mean a non-exclusive inclusion, such that a method or apparatus that comprises a list of elements does not include those elements solely, but may well include other elements not listed.

SUMMARY OF THE INVENTION

According to one aspect of the invention, there is provided a method for providing a reduced order set of parameters associated with a dynamical environment having a plurality of signal sources, the method comprising the steps of:

(i) Inverse transforming an initial reduced cost set of discrete time parameters into a reduced cost set of continuous time parameters;

(ii) Converting the reduced cost set of continuous time parameters into a balanced converted set of parameters;

(iii) Transforming the balanced converted set of parameters into a modified set of discrete time parameters;

(iv) Estimating from the modified set of discrete time parameters a reduced cost set of discrete time parameters;

(v) Repeating steps (i) to (iv) until the reduced cost set of discrete time parameters provides a rate of change value of a cost function that reaches a pre-determined value; and (vi) Providing the balanced reduced cost set of discrete time parameters from the reduced cost set of discrete time parameters after the rate of change value of the cost function reaches the pre-determined value.

Preferably, the pre-determined cost is the rate of change value approximating to zero.

The method may be further characterized by the preceding steps of:

obtaining an initial set of continuous time balanced parameters;

initially transforming the initial set of continuous time balanced parameters into an initial set of discrete time parameters; and initially estimating, from the initial set of discrete time parameters, the initial reduced cost set of discrete time parameters.

Suitably, the method further includes the step of order reducing the balanced reduced cost set of discrete time parameters to provide a reduced order set of parameters.

Preferably, the method further includes inverting the balanced reduced cost set of discrete time parameters to provide an inverted reduced cost set of discrete time parameters.

According to another aspect of the invention there is provided a method for signal separation of a received combined signal originating from a dynamical environment having a plurality of signal sources; the method including:

sampling said combined signal to provide a sampled signal;

processing said sampled signal with an inverted reduced cost set of discrete time parameters obtained from an iterative process of balancing the parameters in the continuous time domain and reducing a cost function of the parameters in the discreet time domain; and providing from said processing, at least one signal separated from said sampled signal.

Suitably, a plurality of signals are separated from said sampled signal.

According to another aspect of the invention there is provided an electronic device for signal separation of a received combined signal originating from the dynamical environment having a plurality of signal sources, the device comprising:

a processor; and a sampler coupled to said processor, wherein in use the sampler effects sampling of the combined signal to provide a sampled signal and thereafter the processor provides for processing the sampled signal with an inverted reduced cost set of discrete time parameters obtained from an iterative process of balancing the parameters in the continuous time domain and reducing a cost function of the parameters in the discreet time domain, and wherein said processor provides, by applying said inverted reduced cost set of discrete time parameters as to said sampled signal, at least one signal separated from said sampled signal.

Suitably, a plurality of signals are separated from said sampled signal.

The electronic device may suitably effect any of the abovementioned steps.

BRIEF DESCRIPTION OF THE DRAWINGS

In order that the invention may be readily understood and put into practical effect, reference will now be made to a preferred embodiment as illustrated with reference to the accompanying drawings in which.

DETAILED DESCRIPTION OF THE PREFERRED EMBODIMENT OF THE INVENTION

Figure 1:
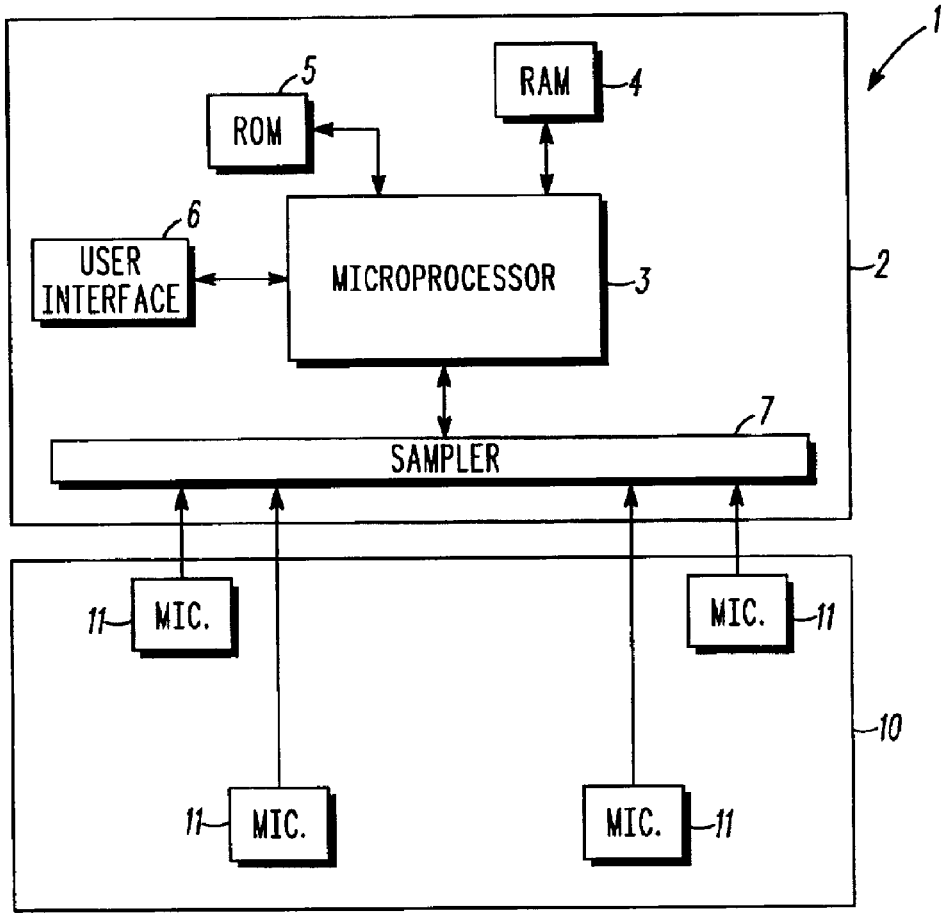
FIG. 1 is a block diagram illustrating an embodiment of a system in accordance with the invention.

With reference to FIG. 1, there is illustrated a system 1 with a device 2 having balanced parameterized description of a dynamical environment 10 that has a plurality of signal sources. The device 2 has a processor 3 with an associated Random Access Memory 4, Read Only Memory 5 and User Interface 6. There is also a sampler 7 coupled to the processor 3. The User Interface 6 is typically a keypad and may also include any combination of a speaker, a radio transmitter, a network interface, or a visual display unit.

The dynamical environment 10 comprises a plurality of microphones 11 that are coupled to the sampler 7. The microphones 11 in use provide the plurality of signal sources to the device 2.

Figure 2:
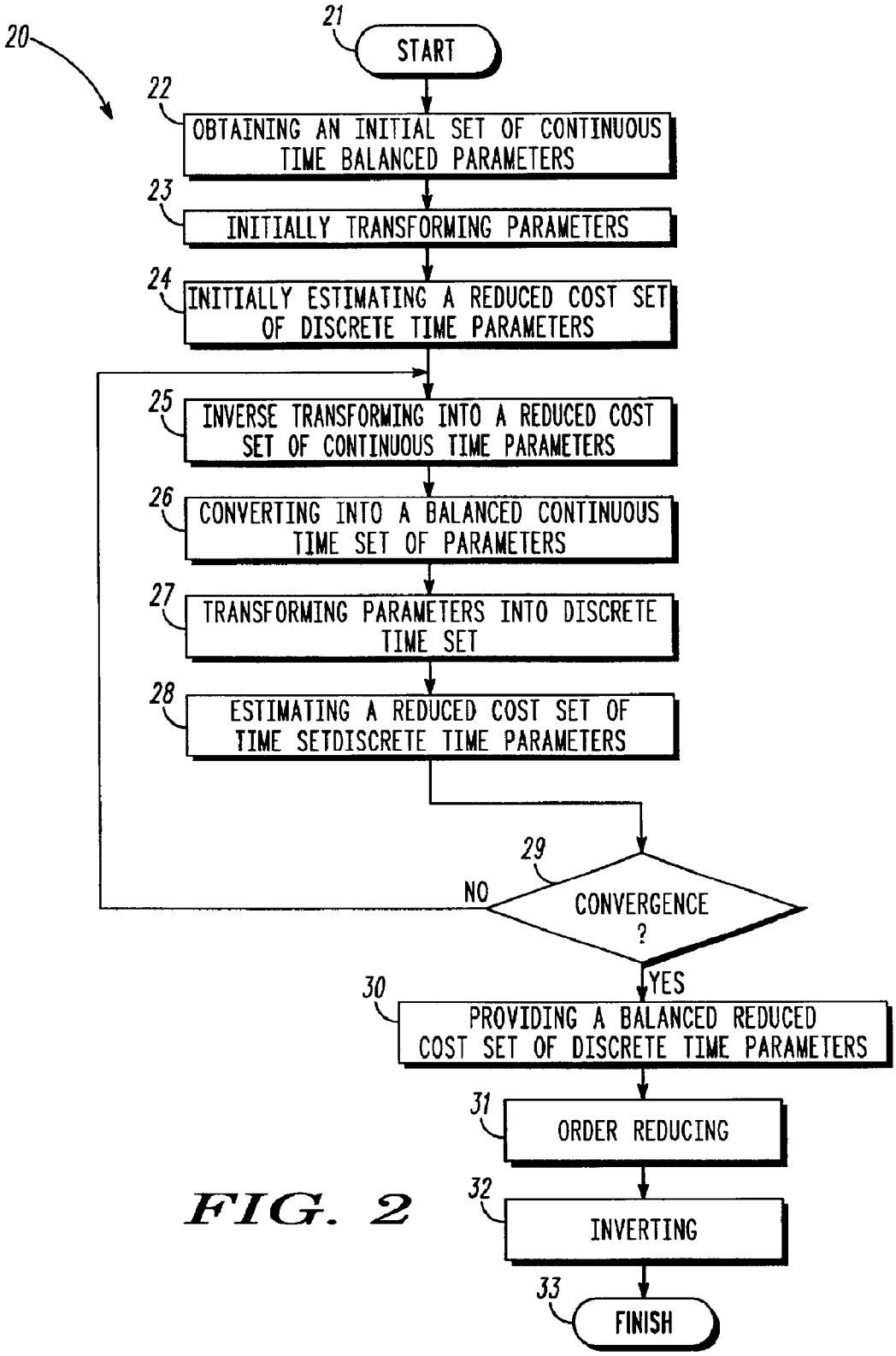
FIG. 2 is a flow diagram illustrating a method for providing a balanced parameterized description of a dynamical environment used by the electronic device of FIG. 1.

Referring to FIG. 2 there is illustrated a method 20 for providing a reduced order set of parameters associated with the dynamical environment 10 having a plurality of signal sources provided by audio signals received at the microphones 11. The method 20 is initiated by a user inputting a start step 21 command at the user interface 6. After the start step 21, an obtaining step 22 results in the RAM 4 obtaining from the user interface 6 (or by accessing the ROM 5) an initial set of continuous time balanced parameters $A_c$, $B_c$, $C_c$, $D_c$ describing a linear time-invariant system as follows:

$$x=A_c x+B_c u \tag{1}$$

$$y=C_c x+D_c u \tag{2}$$

where $y \in R^n$, $u \in R^n$, and $x \in R^N$, n is the number of source signals that can be represented as an n-element vector and N is the order of the system represented as an N-element vector. Further a controllability Grammian $P_c$ and observability Grammian $Q_c$, both N×N matrices, are respectively given by the solution identified by the following dual Lyapunov equations (3) and (4).

$$A_c P_c+P_c A_c^T=-B_c B_c^T \tag{3}$$

$$A_c^T Q_c+Q_c A_c=-C_c^T C_c \tag{4}$$

The system is said to be balanced if $P_c=Q_c=\Sigma_c=\mathrm{diag}(\sigma_1, \sigma_2, \ldots, \sigma_N)$. Note that both in the continuous time case and in the discrete time case, the balanced realization is defined through the diagonalisation of the controllability Grammian $P_c$ and the observability Grammian $Q_c$.

After the obtaining step 22 the processor 3 effects an initial transforming parameters step 23 for transforming the initial set of continuous time balanced parameters into a corresponding initial set of discrete time parameters $A_d$, $B_d$, $C_d$, $D_d$ using bilinear transformations as follows:

$$A_d=(I-A_c)^{-1}(I+A_c) \tag{5}$$

$$B_d=\sqrt{2}(I-A_c)^{-1}B_c \tag{6}$$

$$C_d=\sqrt{2}C_c(I-A_c)^{-1} \tag{7}$$

$$D_d=D_c-C_c(I-A_c)^{-1}B_c \tag{8}$$

where I is the identity matrix with 1's on the diagonal and 0's elsewhere.

The transformed parameters $A_d$, $B_d$, $C_d$, $D_d$ describe a discrete-time linear time-invariant system as follows:

$$x(k+1)=A_d x(k)+B_d u(k) \tag{9}$$

$$y(k)=C_d x(k)+D_d u(k) \tag{10}$$

where at every time instant k, a value of the n-element vector of detected signals y(k) is determined by the values of the n-element vector of source signals u(k) and the state N-element vector of the system x(k) as in equation (10). A subsequent value of a state vector x (representing parameters internal to the system) is in turn dependent on its previous value and on the value of the source signals as in equation (9).

After the transforming step 23 the processor 3 effects an initial estimating step 24 for estimating, from the corresponding initial set of discrete time parameters $A_d$, $B_d$, $C_d$, $D_d$, a reduced cost set of discrete time parameters that is obtained by minimizing a cost function l as follows:

$$l(y, W) = -\log|\det(D_d)| - \sum_{i=1}^{n} \log q_i(y_i) \tag{11}$$

where $W=\{A_d, B_d, C_d, D_d\}$, $\det(D_d)$ is the determinant of the matrix $D_d$, $q_i(y_i)$ is an approximation of the probability distribution function $p_i(y_i)$. A total differential dl(y,W) can be obtained as follows:

$$dl(y, W)=l(y, W+dW)-l(y, W) \tag{12}$$

Using a natural gradient technique, we have:

$$dl(y, W)=-tr(dDD^{-1})+\phi^T(y)dy \tag{13}$$

where tr(•) is the trace of the matrix, and $\phi(y)$ is a vector of nonlinear activation functions:

$$\varphi_i(y_i) = -\frac{d\log q_i(y_i)}{dy_i} = -\frac{q_i'(y_i)}{q_i(y_i)} \tag{14}$$

From this, it is possible to obtain the following updating rules for $C_d$ and $D_d$ respectively:

$$C_d=C_d-\eta\phi(y)x^T \tag{15}$$

$$D_d=D_d+\eta(I-\phi(y)u^T D_d^T)D_d \tag{16}$$

where $\eta$ is an adaptation step.

The updating rules for $A_d$ and $B_d$ are determined from the following analysis. From the state equation (9), we can obtain:

$$\frac{\partial l(y, W)}{\partial x(k)} = C^T \varphi(y(k)) \tag{17}$$

Hence, for a time instant k, we have:

$$\frac{\partial l(y, W)}{\partial A} = \sum_{l=1}^{N} \frac{\partial l(y, W)}{\partial x_l(k)} \frac{\partial x_l(k)}{\partial A} \tag{18}$$

-continued $$\frac{\partial l(y, W)}{\partial B} = \sum_{l=1}^{N} \frac{\partial l(y, W)}{\partial x_l(k)} \frac{\partial x_l(k)}{\partial B} \tag{19}$$

where $$\frac{\partial x_l(k)}{\partial A} \text{ and } \frac{\partial x_l(k)}{\partial B}$$

can be determined as follows:

$$\frac{\partial x_l(k+1)}{\partial a_{ij}} = \sum_{p=1}^{N} a_{lp} \frac{\partial x_p(k)}{\partial a_{ij}} + \delta_{li} x_j(k) \tag{20}$$

$$\frac{\partial x_l(k+1)}{\partial b_{iq}} = \sum_{p=1}^{N} a_{lp} \frac{\partial x_p(k)}{\partial b_{iq}} + \delta_{li} u_q(k) \tag{21}$$

for l,i,j=1,2, . . . , N and q=1,2, . . . , n. $\delta_y$ is the Kronecker delta function.

An update equations for $a_v$, the elements of $A_d$, and for $b_{1q}$, the elements of $B_d$ are obtained as follows:

$$a_{ij} = a_{ij} - \eta\varphi(y)^T \sum_{l=1}^{N} C_l \frac{\partial x_l}{\partial a_{ij}} \tag{22}$$

$$b_{ij} = b_{ij} - \eta\varphi(y)^T \sum_{l=1}^{N} C_l \frac{\partial x_l}{\partial b_{ij}} \tag{23}$$

and $$\frac{\partial x_l(k+1)}{\partial a_{ij}} = \sum_{p=1}^{N} a_{lp} \frac{\partial x_p(k)}{\partial a_{ij}} + \delta_{li} x_j(k) \tag{24}$$

and $$\frac{\partial x_l(k+1)}{\partial b_{iq}} = \sum_{p=1}^{N} a_{lp} \frac{\partial x_p(k)}{\partial b_{iq}} + \delta_{li} u_q(k) \tag{25}$$

Hence from the above, equations (14)–(25) allow for updating the values of $A_d$, $B_d$, $C_d$, $D_d$.

After the estimating step 24 the processor 3 effects an inverse transforming step 25 for inverse transforming the reduced cost set of discrete time parameters into a reduced cost set of continuous time parameters through inverse bilinear transformations as follows:

$$A_c=(I+A_d)^{-1}(A_d-I) \tag{26}$$

$$B_c=\sqrt{2}(I+A_d)^{-1}B_d \tag{27}$$

$$C_c=\sqrt{2}C_d(I+A_d)^{-1} \tag{28}$$

$$D_c=D_d-C_d(I+A_d)^{-1}B_d \tag{29}$$

The method 20 next effects a converting step 26 for converting the reduced cost set of continuous time parameters into a balanced converted set of parameters, wherein in the balanced parameter set, the parameters $B_c$ and $D_c$ are already obtained. The values of parameters $A_c$ and $C_c$ can be obtained according to the formulae given in C. T. Chou and J. M. Maciejowski, "System Identification using Balanced Parametrization", *IEEE Trans. Automatic Control*, Vol. 42, pp. 956–974, 1997.

The processor 3 then effects a transforming step 27 for transforming the balanced converted set of parameters into a modified set of discrete time parameters. Thereafter, an estimating step 28 provides for estimating from the modified set discrete time parameters a reduced cost set of discrete time parameters. It should be noted that steps 27 and 28 are basically identical to respective steps 23 and 24 and therefore to avoid repetition steps 27 and 28 are not described in detail.

The processor 3 next effects a test step 29 to determine convergence of the reduced cost set of discrete time parameters (ideally this will be a minimal cost set of discrete time parameters). In this regard, convergence is detected when a rate of change value of the cost function l that reaches a pre-determined value, the pre-determined value approximating to zero (i.e. a rate of change minimum).

If there is no convergence detected at test step 29 then steps 25 to 28 are repeated until convergence is detected and thereafter the processor effects a providing step 30 for providing a balanced reduced cost set of discrete time parameters from the reduced cost set of discrete time parameters after the rate of change value of the cost function reaches the pre-determined value. This is typically a rate of change value approximating to zero and the balanced minimal cost converted set of parameters are those in equations (9–10).

The processor 3 next effects an order reducing step 31 for order reducing the balanced converted set of parameters to provide a reduced order set of parameters. This is done by truncating parameters $A_c$, $B_c$, $C_c$, $D_c$ at the point where the diagonal elements of $A_c$ reduce in value sharply, so that all the discarded diagonal elements of $A_c$ are considerably smaller in value than the preserved diagonal elements of $A_c$. Thus performed truncation is known to yield a reduced order system which is the best approximation of the original system.

The processor 3 then effects an inverting step 32 for inverting the reduced order set of parameters to provide an inverted reduced order set of parameters after which the method 20 initially terminates at a finish step 33.

The invention essentially provides for a method for signal separation of a received combined signal originating from a dynamical environment having a plurality of signal sources. The method includes sampling the combined signal to provide a sampled signal and processing the combined signal with an inverted reduced cost set of discrete time parameters obtained from an iterative process of balancing the system parameters in the continuous time domain and reducing a cost function of the system parameters in the discreet time domain.

After the finish step 33, the inverted reduced cost set of discrete time parameters are stored in the RAM 4 or downloaded into the ROM 5 by any known method. In use, the invention provides for a method or device 2 for signal separation of a received combined signal originating from the dynamical environment 10 having a plurality of signal sources. The method or device 2 for signal separation includes sampling (by the sampler 7) the combined signal (received from the Microphones 11) to provide a sampled signal. The processor 3 then provides for processing the sampled signal with the inverted reduced cost set of discrete time parameters obtained from the iterative process of balancing the system parameters in the continuous time domain and reducing a cost function of the system parameters in the discreet time domain. The processor 3 then effects a providing step for providing at least one signal separated from the sampled signal. However, more often a plurality of signals, or even all signals, are separated from the sampled signal.

Advantageously, the present invention provides for a useful method and device for recovering input signals mixed by a dynamical linear time-invariant system with no access to the input signals and with the parameters of the system not known. The method deals with discrete time signals, which makes it suitable for realizations using discrete time devices such as computers and microprocessors. The method is also guaranteed to be stable. In addition, unlike previously known methods, the disclosed method avoids the need to resolve a separate and difficult problem of pre-estimating the order (complexity) of the dynamical linear time-invariant system.

The detailed description provides a preferred exemplary embodiment only, and is not intended to limit the scope, applicability, or configuration of the invention. Rather, the detailed description of the preferred exemplary embodiment provides those skilled in the art with an enabling description for implementing a preferred exemplary embodiment of the invention. It should be understood that various changes may be made in the function and arrangement of elements without departing from the spirit and scope of the invention as set forth in the appended claims.

We claim:

1. A method for providing a reduced order set of parameters associated with a dynamical environment having a plurality of signal sources, the method comprising the steps of:

(i) Inverse transforming an initial reduced cost set of discrete time parameters into a reduced cost set of continuous time parameters;

(ii) Converting the reduced cost set of continuous time parameters into a balanced converted set of parameters;

(iii) Transforming the balanced converted set of parameters into a modified set of discrete time parameters;

(iv) Estimating from the modified set of discrete time parameters a reduced cost set of discrete time parameters;

(v) Repeating steps (i) to (iv) until the reduced cost set of discrete time parameters provides a rate of change value of a cost function that reaches a pre-determined value; and (vi) Providing the balanced reduced cost set of discrete time parameters from the reduced cost set of discrete time parameters after the rate of change value of the cost function reaches the pre-determined value.

2. A method as claimed in claim 1, wherein the predetermined cost is the rate of change value approximating to zero.

3. A method as claimed in claim 1, further including the preceding steps of:

obtaining an initial set of continuous time balanced parameters;

initially transforming the initial set of continuous time balanced parameters into an initial set of discrete time parameters; and initially estimating, from the initial set of discrete time parameters, the initial reduced cost set of discrete time parameters.

4. A method as claimed in claim 1, wherein the method further includes the step of order reducing the balanced reduced cost set of discrete time parameters to provide a reduced order set of parameters.

5. A method as claimed in claim 1, wherein the method further includes inverting the balanced reduced cost set of discrete time parameters to provide an inverted reduced cost set of discrete time parameters.

6. A method for signal separation of a received combined signal originating from a dynamical environment having a plurality of signal sources; the method including:

sampling said combined signal to provide a sampled signal;

processing said sampled signal with an inverted reduced cost set of discrete time parameters obtained from an iterative process of balancing the parameters in the continuous time domain and reducing a cost function of the parameters in the discreet time domain; and providing from said processing, at least one signal separated from said sampled signal.

7. A method as claimed in claim 6, wherein a plurality of signals are separated from said sampled signal.

8. An electronic device for signal separation of a received combined signal originating from the dynamical environment having a plurality of signal sources, the device comprising:

a processor; and a sampler coupled to said processor, wherein in use the sampler effects sampling of the combined signal to provide a sampled signal and thereafter the processor provides for processing the sampled signal with an inverted reduced cost set of discrete time parameters obtained from an iterative process of balancing the parameters in the continuous time domain and reducing a cost function of the parameters in the discreet time domain, and wherein said processor provides, by applying said inverted reduced cost set of discrete time parameters as to said sampled signal, at least one signal separated from said sampled signal.

* * * * *